United States Patent [19]

Kiba et al.

[11] Patent Number: 5,020,472

[45] Date of Patent: Jun. 4, 1991

[54] WAX COATING DEVICE

[75] Inventors: Hiroshi Kiba; Hajime Akeno, both of Hiroshima, Japan

[73] Assignee: Mazda Motor Corporation, Hiroshima, Japan

[21] Appl. No.: 362,603

[22] Filed: Jun. 7, 1989

[30] Foreign Application Priority Data

Jun. 8, 1988 [JP] Japan ..... 63-140913

[51] Int. Cl.[5] ..... B05B 13/02

[52] U.S. Cl. ..... 118/668; 118/314

[58] Field of Search ..... 118/314, 324, 680, 697, 118/676, 679, 681, 686, 313, 314, 315, 317, 323, 324

[56] References Cited

U.S. PATENT DOCUMENTS

| | | | |
|---|---|---|---|
| 3,448,717 | 6/1969 | Kuhlman | 118/680 |
| 3,561,398 | 2/1971 | Rose | 118/680 |
| 3,814,053 | 6/1974 | Anderson | 118/680 |
| 4,357,900 | 11/1982 | Buschor | 118/324 |
| 4,714,044 | 12/1987 | Kikuchi et al. | 118/697 |
| 4,768,462 | 9/1988 | Kuronaga et al. | 118/314 |

FOREIGN PATENT DOCUMENTS

| | | | |
|---|---|---|---|
| 62-114676 | 5/1987 | Japan . | |
| 62-237961 | 10/1987 | Japan . | |
| 2045463 | 10/1980 | United Kingdom | 118/680 |

*Primary Examiner*—Willard E. Hoag

*Attorney, Agent, or Firm*—Fleit, Jacobson, Cohn, Price, Holman & Stern

[57] ABSTRACT

A coating device for coating corrosion protection wax on a lower surface of a floor panel of a vehicle transferred by a conveyer comprises first robots for coating the wax on a first area formed within the lower surface at opposite peripheral portions to extend in a transfer direction in which the vehicle is transferred, and second robot for coating the wax on a second area formed within the lower surface of the floor panel to intervene between the first area. The first and second robot are arranged in serial in the transfer direction. The wax can be surely and uniformly coated on the first and second areas and coating work can be completed quickly.

8 Claims, 8 Drawing Sheets

WAX COATING DEVICE

BACKGROUND OF THE INVENTION

1. Field of the Present Invention

This invention relates to a wax coating device, and specifically to a device for coating a corrosion protection wax on a vehicle body.

2. Description of the Prior Art

In recent years, it has been known to provide a corrosion protection wax coating on a lower surface of a floor panel of a finished vehicle. However, elements such as a fuel tank, exhaust pipe, parts for driving mechanism and the like or disposed at a lower portion of the vehicle tend to deteriorate workability of coating the floor panel. In view of the above, there has been installed a robot having multiple joints for controlling an application nozzle at a coating station to provide flexibility in executing the coating work to thereby get a homogenous and reliable coating.

The multiple joint robot is controlled based on teaching data stored in accordance with kind of the vehicle being transferred.

Japanese Patent Public Disclosure No. 62-114676, laid open to the public on May 26, 1987, discloses a triaxial type robot, the nozzle of which can move triaxially which is disposed by a transfer path for transferring the vehicle. The triaxial type robot is utilized for providing a coating a corrosion protection wax on a lower portion a of the vehicle.

Japanese Patent Public Disclosure No. 62-23796, laid open to the public on Oct. 17, 1987, discloses a corrosion protection wax coating device wherein a vehicle is supported and transferred by a truck having a transverse positioning device and a longitudinal positioning device so that the vehicle is accurately positioned for the coating work.

According to conventional corrosion protection wax coating work, a single coating robot is employed for the purpose of coating.

It should, however, be noted that the conventional manner for coating the corrosion protection wax on the floor panel is not efficient. This is because the workability in coating the corrosion wax on the floor panel depends on areas thereof. Generally, it is relatively easy to coat the wax on longitudinally opposite peripheral areas of the lower surface of the floor panel. On the other hand, it is relatively complicated to coat an intermediate area of the floor panel other than the peripheral areas because a lot of installations are disposed adjacent thereto so that a multiple joint type robot is needed for coating the intermediate area of the floor panel. It is not necessary to employ such a multiple joint type robot for coating the surface in order to obtain a desirable quality. Nevertheless, if a multiple joint type robot is applied for the coating work in coating the peripheral portions, time is consumed without utilizing the true merit of the multiple joint type robot, because control for the multiple joint type robot is complicated. In addition, the multiple joint type robot needs a broader space for moving a wax application nozzle thereof.

However, according to the conventional manner, there is no alternative but to utilize a multiple joint type robot because only one robot is allowed to be, installed at a given location. Therefore, a remarkable problem is produced in case where a thick coating is needed since a vehicle manufacturing line speed has been predetermined.

In this connection, the corrosion protection wax has normally, a thickness of 30 μm for domestic use. However, a greater thickness of the corrosion protection wax coating, for example, 300 μm, is required to provide a stronger corrosion protection effect in a foreign country, and specifically in a cold areas such as Northern Europe and North America where a salt is dispersed for preventing roads from freezing.

SUMMARY OF THE INVENTION

It is therefore an object of the present invention to provide a coating device for coating a corrosion protection wax on a floor panel of a finished vehicle which can provide a homogenous wax coating on a lower surface of the floor successfully.

It is another object of the present invention to provide a coating device which carries out a wax coating process on the lower surface of the floor panel in a shortened time successfully.

According to the present invention, the above and other objects of the invention can be accomplished by a coating device for coating a corrosion protection wax on a lower surface of a floor panel of a vehicle transferred by conveyer means comprising first robot means for coating the corrosion protection wax on a first area formed within the lower surface of the floor panel at opposite peripheral portions to extend in a transfer direction in which the vehicle is transferred, and second robot means for coating the corrosion protection wax on a second area formed within the lower surface of the floor panel to intervene between the first area, the first and second robot means being arranged in serial in the transfer direction.

The corrosion protection wax preferably includes a petrolatum oxide, petroleum base wax, petroleum sulfonate and petroleum base solvent. Usually, a compound of the wax is adjusted for a domestic version vehicle for domestic use and foreign version vehicle for exporting, respectively. The wax for domestic use is lower than that for exporting in viscosity.

Preferably, a pair of the first robot means are disposed at opposite sides of a transfer line on which a wax coating station is provided. The first area is located at substantially opposite peripheral portions of the lower surface or outer surface extending along the transfer line. There are disposed few parts in the first area so that coating work can be relatively easily done by utilizing the first robot means. In the first area, there are only a few areas where the coating is not appropriate, such as an area in which a wheel is disposed. The second area is located at a middle portion in the lower surface other than the first area. Many parts, such as an exhaust pipe and a vehicle driving mechanism are arranged adjacent to the second area so that the configuration or undulation of the second area is complicated and successful and smooth coating work is difficult.

The second robot means is actuated for coating the second area of the lower surface. The second robot is preferably constituted by a multiple joint type robot which is suitable for coating a relatively complicated surface.

The first area and second area is usually divided in the vicinity of side frame sections of the floor panel to extend in the transfer direction.

The conveyer means is preferably constituted by a slat conveyer.

According to the present invention, coating work is shared by the first and second robot means in a manner such that the first area of the lower surface of the floor panel is coated by the first robot means and the second area is coated by the second robot means resulting in a reduction of a coating work time. This means that the coating work can be carried out thoroughly to get a homogenous and desirable quality of the coating across the whole lower surface. Further, the coating time can be reduced successfully while maintaining a reasonable line speed.

The above and other objects and features of the present invention will become apparent from the following description when considered in connection with the preferred embodiment, taking reference to the accompanying drawings.

DESCRIPTION OF THE PREFERRED EMBODIMENT

Figure 1:
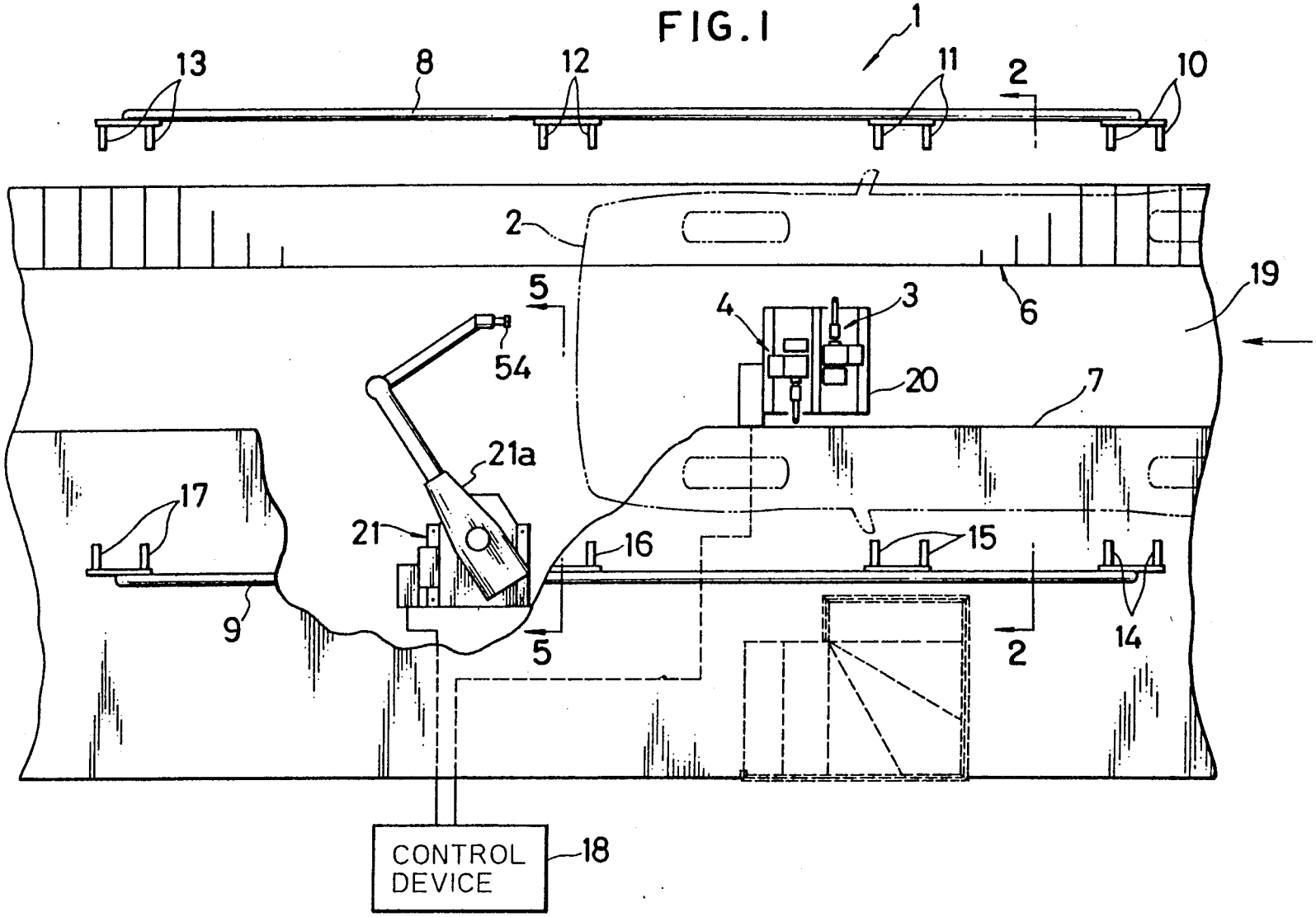
FIG. 1 is a schematic plan view of a coating device in accordance with a preferred embodiment of the present invention.
Figure 2:
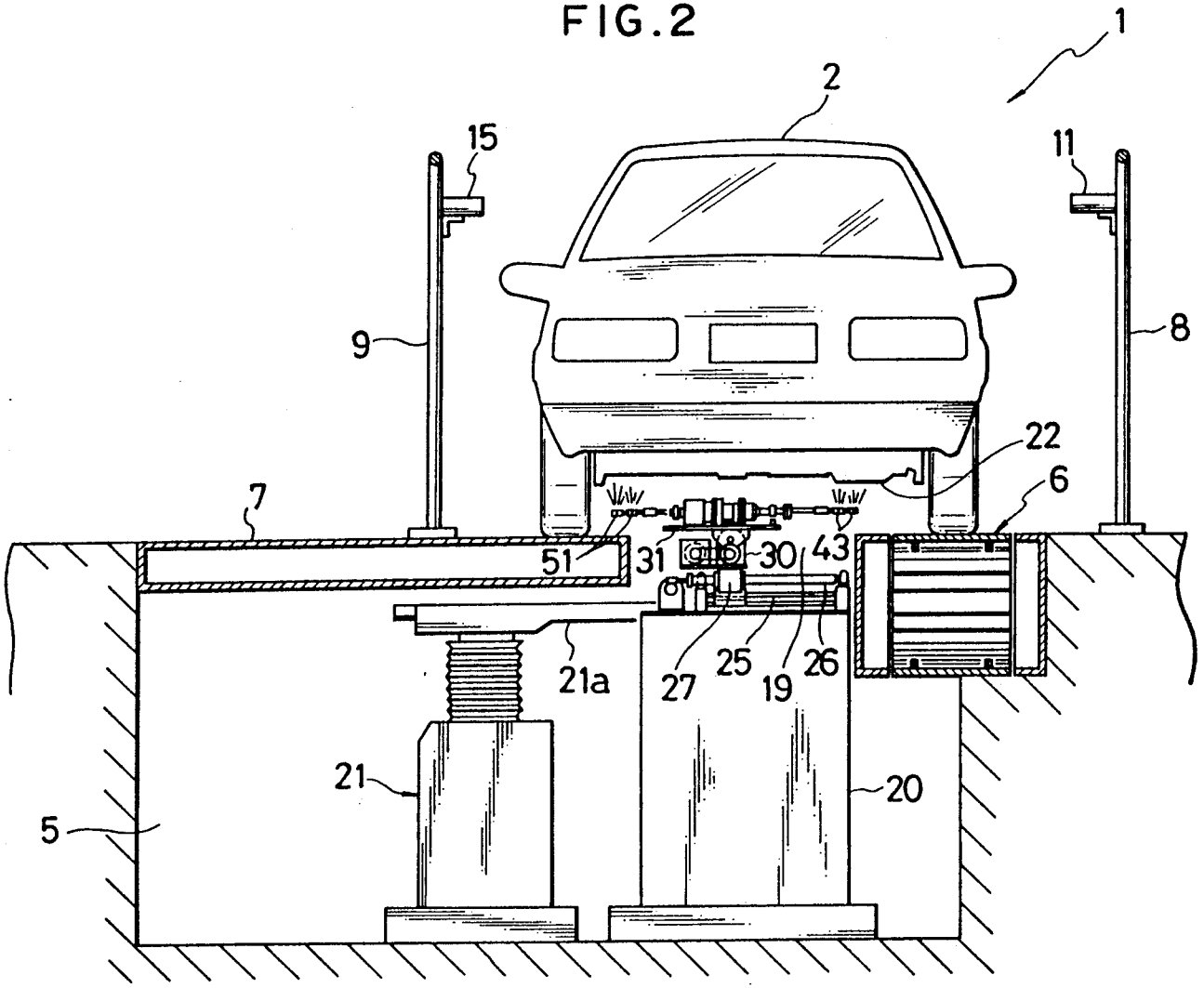
FIG. 2 is a sectional view taken along section line II—II of FIG. 1.

Referring to the drawings, specifically to FIG. 1 and FIG. 2, there is shown a schematic view of a wax coating device 1. A vehicle 2 is transferred from a right side to a left side in FIG. 1. There is provided an installation chamber 5 below a floor line for installing a pair of first robots 3 and 4, and a second robot 21 therein. A conveyer 6 is provided at an upper portion of a right side wall for conveying the vehicle 2 to carry right front and rear wheels of the vehicle. On an upper portion of the other side of the wall of the chamber 5 is provided a supporting plate 7 extending in a transfer direction or longitudinal direction along which the vehicle is transferred. The plate 7 rotatably carries a front and rear left wheels of the vehicle 2. A pair of frames 8 and 9 are disposed at opposite sides of the vehicle 2. There are provided illuminants 10, 11, 12 and 13 and receptors 14, 15, 16 and 17 on the frames 8 and 9 facing to each other for detecting a position of the vehicle transferred. The illuminants 10, 11, 12 and 13 and receptors 14, 15, 16 and 17 are connected with a control device 18. The first robots 3 and 4 are arranged on a base 20 in the chamber 5 at a relatively upstream side thereof in a manner that the first robots 3, 4 are directed to an opening 19 defined by the conveyer 6 and the plate 7. The second robot 21 is arranged away from the first robots 3, 4 downstream thereof in the transfer direction by a certain distance. The second robot 21 is of a multiple joint type which can make five different movements.

The pair of first robots 3 and 4 have the same function and are disposed in a mirror image relationship with each other with regard to a line along the transfer direction.

Figure 3:
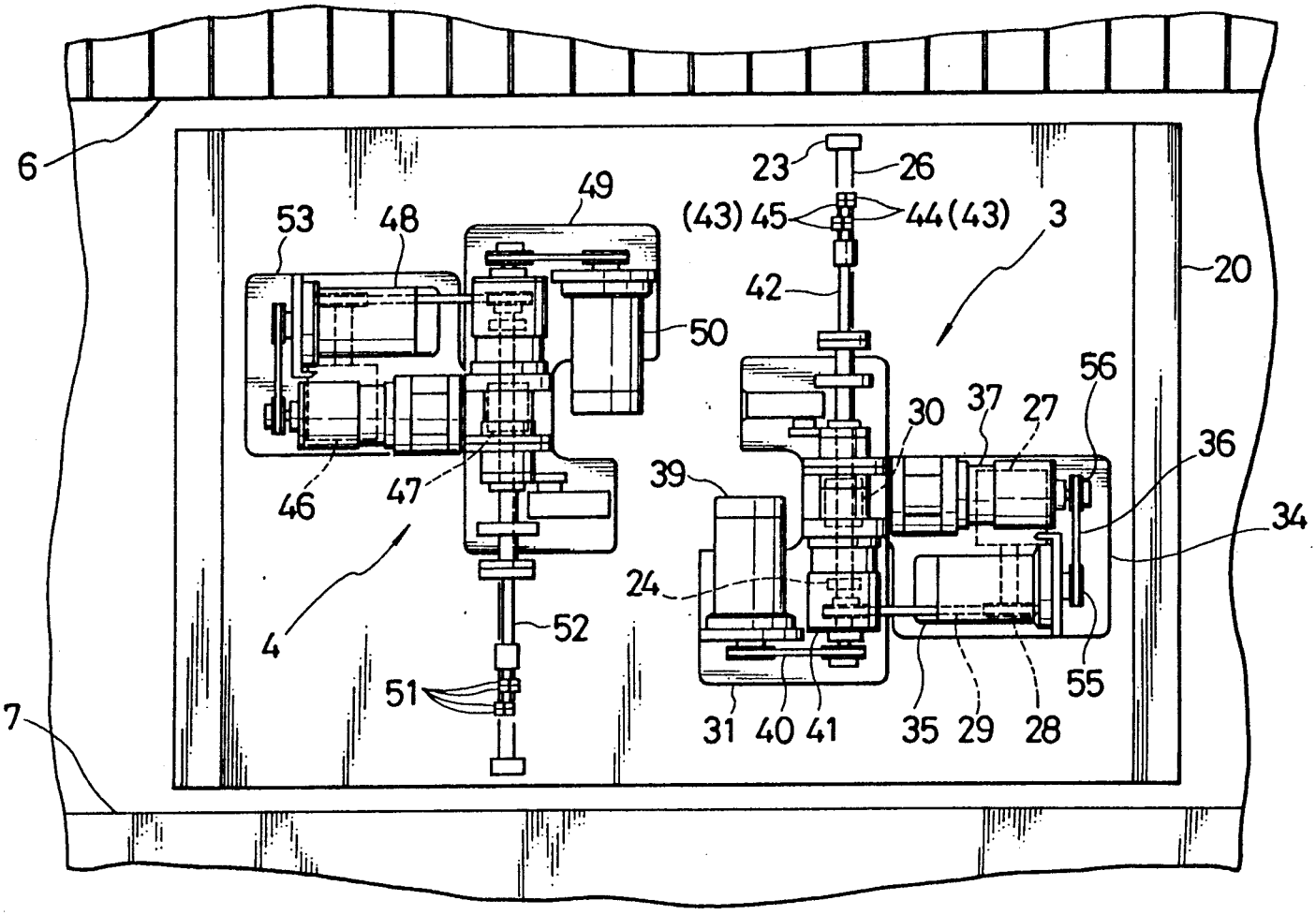
FIG. 3 is an enlarged plan view of first robots.
Figure 4:
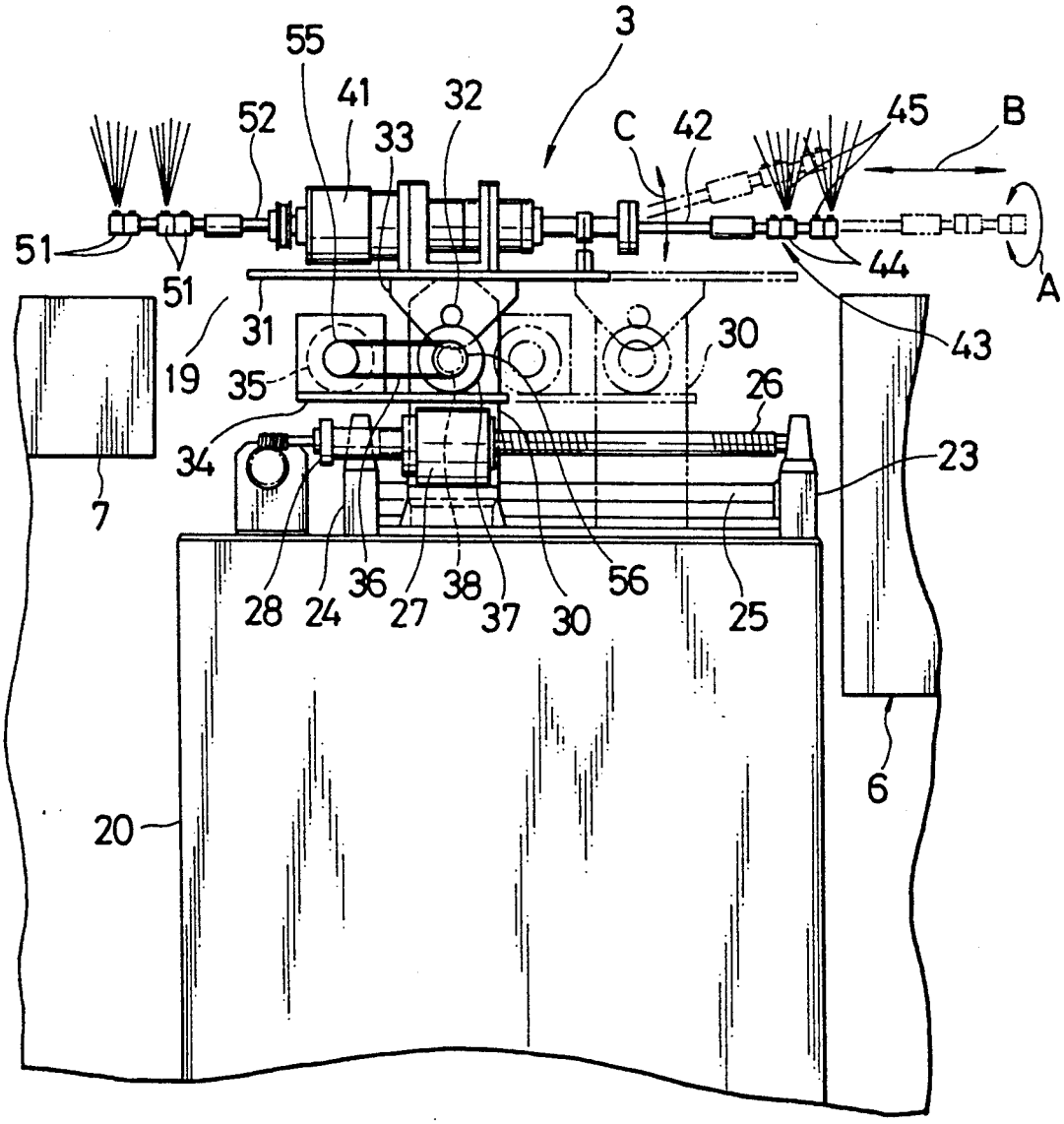
FIG. 4 is an enlarged elevational view of the first robots.

Hereinafter, a description will be made about one of the first robots 3 disposed upstream of the other one, taking reference to FIG. 2 to FIG. 4. The robot 3 is provided with a pair of journal portions 23 and 24 fixed to the base 20, a guide shaft 25 extending transversely and a drive shaft 26 formed with screw. The guide shaft 25 and the drive shaft 26 are rotatably mounted on the journal portions 23 and 24. The drive shaft 26 is driven by a motor 27 disposed upstream thereof through a pulley 28 and belt 29. The drive shaft 26 is brought into a meshing engagement with a carriage 30 through a bolt block provided on the carriage 30. The carriage 30 extending upwardly is also movably carried by the guide shaft 25 at a lower portion thereof so that the carriage 30 can move transversely in accordance with a rotative movement of the drive shaft 26 driven by the motor 27. There is provided a swingable base plate 31 extending transversely above the carriage 30. The base plate 31 is carried by a pair of swing arm plates 33 which are pivotally mounted on the carriage 30 through a pin 32 fixed to the carriage 30. The carriage is provided with a stationary plate 34 horizontally extending at an intermediate portion with regard to a vertical direction. A motor 35 and a harmonic member 37 are arranged on the plate 34 in parallel with each other with regard to the traverse direction. The motor 35 is provided with a pulley 55 at an end portion of a rotation shaft thereof. The harmonic member 37 is provided with a pulley 56 at an end portion of a rotation shaft thereof. The pulley 55 is connected with the pulley 56 through a belt 36. The harmonic member 37 is also provided with a gear 38 which is meshed with a gear portion formed on a lower portion of the swing arm plates 33. Thus, a rotation of the motor 35 is transferred to the plates 33 to produce a swinging movement thereof through the pulley 55, belt 36, pulley 56, harmonic member 37, gear 38 and the gear potion so that the swingable plate 31 swings in a clockwise and a counterclockwise direction within an angular amount of about 15 degrees.

There are disposed a motor 39 and a harmonic member 41 connected with the motor 39 through a belt 40 on the swingable plate 31. A nozzle device 43 is provided on one tip end portion of an arm 42 extending from the harmonic member 41 for injecting a corrosion protection wax upwardly. The nozzle device is provided with one pair of nozzles 44 adapted to inject a wax of a relatively low viscosity for domestic use and form a relatively thin coating and the other pair of nozzles 45 adapted inject a wax of a relatively high viscosity for exporting and to form a relatively thick coating. An injection pressure is adjusted at about 17 kg/cm2 for the nozzles 44 and at about 70 kg/cm2 for the nozzles 45. The nozzle device 43 can rotate around an axis of the arm 42 by an angular amount of about 90 degrees.

The other first robot 4 is also provided with a motor 46 for moving a carriage 47 transversely, motor 48 for swinging a swingable plate 49, motor 50 for rotating an arm 52 with a nozzle device and a stationary plate 53.

Hereinafter, a description about the second robot 21 will be followed taking reference to FIGS. 1, 5 and 6.

Figure 5:
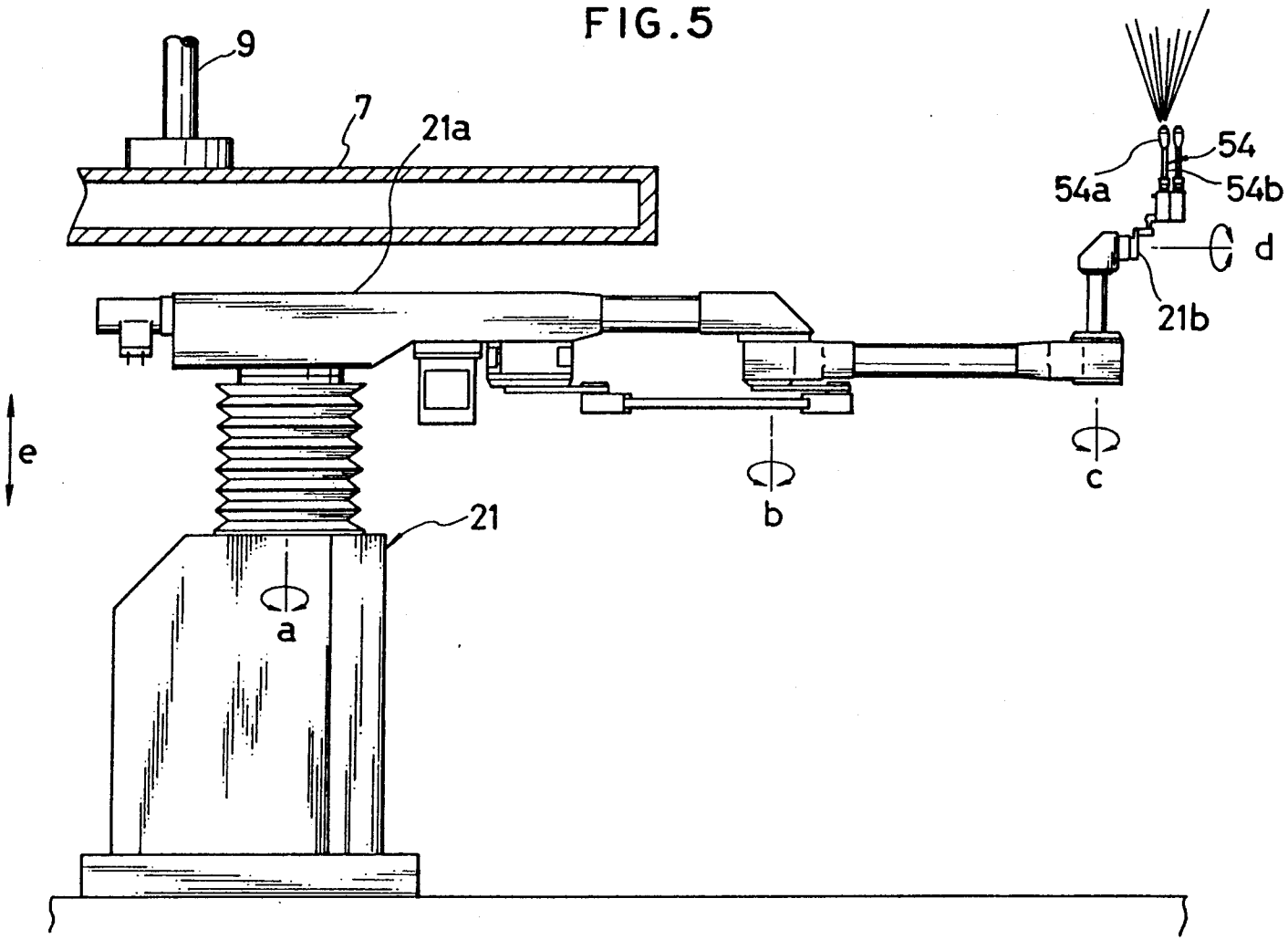
FIG. 5 is a side view of second robot taken along a line V—V of FIG. 1.

As shown in FIG. 5, the robot 21 is of a multiple joint type which can move around axes a, b, c, and d and further can move in an up and down direction as shown by an arrow e. This means that the second robot 21 can make five different basic movements. The second robot 21 can be moved in the transfer direction as well. The second robot 21 is provided with an arm 21*a* which is provided with a nozzle device 54 at a tip end portion thereof. The nozzle device 54 is provided with a nozzle 54*a* adapted to inject the wax for domestic use and form a relatively thin wax coating and a nozzle 54*b* adapted to inject the wax for exporting and form a relatively thick wax coating. The nozzle device 54 is directed, to the opening 19 so that the orientation thereof can be changed.

Figure 6:
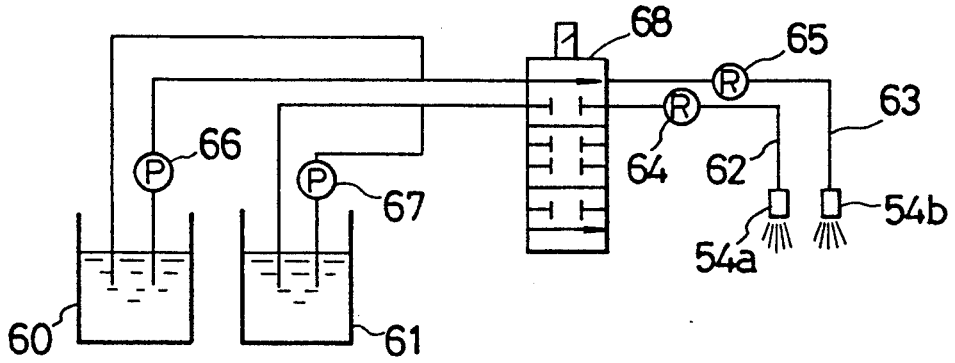
FIG. 6 is a schematic view showing a wax supply system for the second robot.
Figure 7:
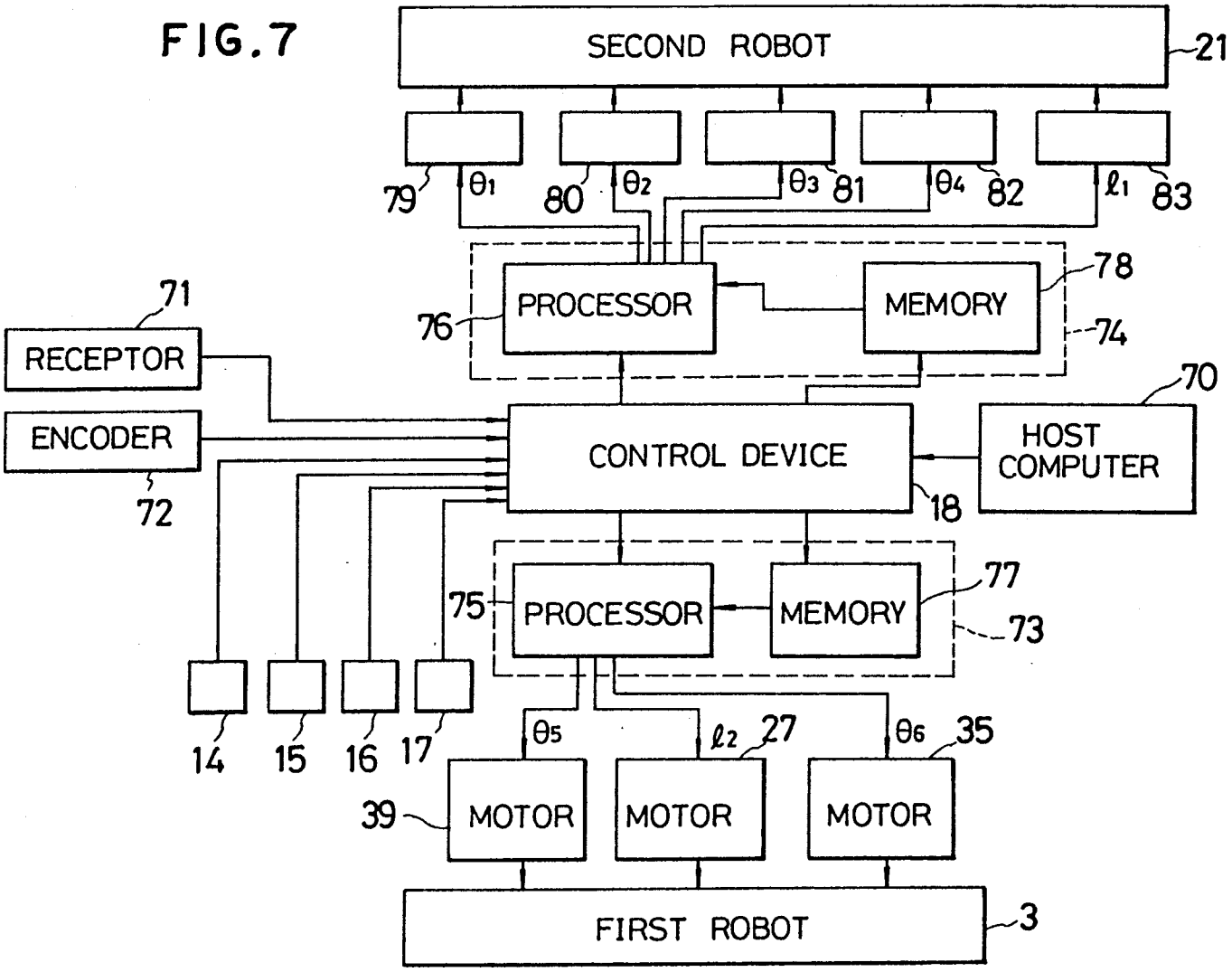
FIG. 7 is a block diagram of a control system for the coating device.

The respective nozzles 54*a* and 54*b* are connected to supply tanks 60 and 61 by supply lines 62, 63 as shown in FIG. 6. There are provided pressure regulators 64, 65 for regulating supply pressure by which the waxes are injected from the nozzles 54*a*, 54*b* and pumps 66 and 67 for supplying the waxes on the lines 62 and 63 respectively. The regulator 64 for the domestic version vehicle is adjusted to provide a supply pressure of about 20 kg/cm2 and the regulator 65 for the foreign version vehicle is adjusted to provide a supply pressure of about 100 kg/cm2. There is provided a solenoid valve 68 for selectively actuating the nozzles 54*a* and 54*b*. The first robots 3, 4 are provided with a wax supply system similar to the aforementioned system arranged for the second robot 21.

The first robots 3, 4 and second robot 21 are controlled by a control device 18 connected with a host computer 70.

The control device 18 receives a signal denoting a kind of a vehicle to be coated from a receptor or photoelectric tube 71, a signal denoting a transfer speed of the line from a line speed sensor 72 including an encoder and a signal denoting other vehicle information about the vehicle from the computer 70 and signals denoting the position of the vehicle in the transfer line from the receptors 14, 15, 16 and 17. The vehicle information can be provided directly by an operator without utilizing the computer 70.

The control device 18 is connected with a first controller 73 for controlling the first robots 3, 4 and a second controller 74 for controlling the second robot 21 so as to provide signals denoting the line speed, the kind of the vehicle, the position of the vehicle and the vehicle information. The controllers 73 and 74 comprise processors 75 and 76 and memories 77 and 78 for storing teaching data and providing the processors 75 and 76 with signals as the data. The processor 75 of the first controller 73 produces a sinal $\theta 5$ denoting an amount of rotative movement around an axis A of the robot 3 to the motor 39, a signal 12 denoting a movement along an axis B of the robot 3 to the motor 27 and a signal $\theta 6$ denoting an amount of rotative movement of the robot 3 around an axis C to the motor 35. The motors 39, 27 and 35 move the robot 3 in accordance with the signals $\theta 5$, 12 and $\theta 6$.

The processor 76 of the second controller 74 produces a signal $\theta 1$ to an actuator 79 for moving the robot 21 around the axis a, a signal $\theta 2$ to an actuator 80 for moving the robot 21 around the axis b, a signal $\theta 3$ to an actuator 81 for moving the robot 21 around the axis c a signal $\theta 4$ to an actuator 82 for moving the robot 21 around the axis d and a signal 11 to an actuator 83 for moving the robot 21 in the direction of the arrow e.

In operation, the finished vehicle 2 to be coated is transferred to the wax coating station by the conveyer 6. When the receptor 14 has detected the vehicle 2, the control device 18 causes the first robots 3, 4 to actuate for ejecting the corrosion protection wax from the nozzle devices 43 and 51 in accordance with the transfer line speed determined by the speed of the conveyer 6 the data stored in the memory 73.

Figure 8:
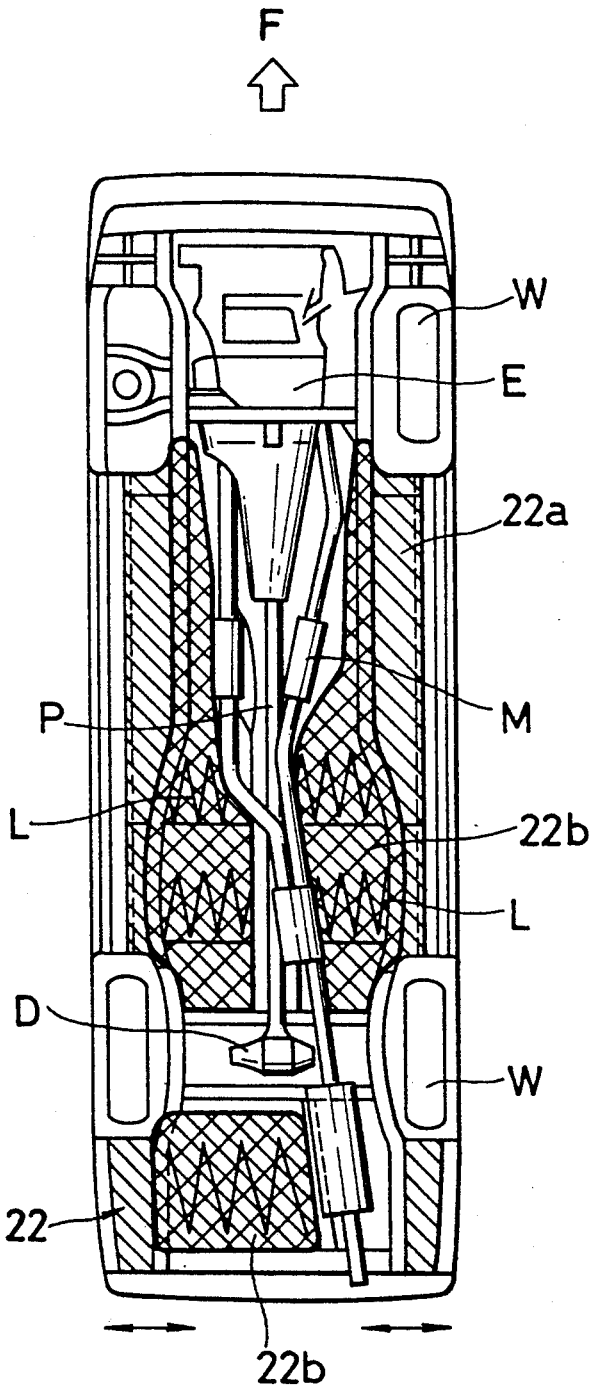
FIG. 8 is a view showing a first area and second area subjected to a wax coating.

In this process, the control device 18 controls movements of the nozzle devices 43 and 51 by utilizing the motors 27, 35, 39, 46, 48 and 50 so that the anti corrosion wax is applied on a lower surface of a floor panel 22 of the vehicle 2, specifically on a first area 22*a*, which area is peripheral portions of the floor panel 22 formed at opposite sides in the traverse direction of the vehicle 2 as shown in FIG. 8. The nozzle devices 43 and 51 are controlled to move transversely as shown by arrows in FIG. 8 as the vehicle is being transferred.

Then, when the receptor 16 detects the vehicle 2, the control device 18 causes the second robot 21 to actuate for injecting the wax from the nozzle device 54 based on the conveyer speed and the data stored in the memory 74 toward the lower surface of the floor panel 22, specifically toward a second area 22*b* formed at an intermediate portion intervening between the first area 22*a*.

In this process, the nozzle device 54 is controlled to move back and forth as shown by line L in FIG. 8 so that the wax can be surely and uniformly coated on the second area 22 which has a complicated undulation or configuration in comparison with the first area 22*a* because many parts of the driving mechanism and exhaust system and the like are arranged adjacent to the second area 22*b*. It should be noted that the nozzle device 54 is controlled so as not to coat the wax on certain installations such as an engine E, exhaust piping having a muffler M, a propeller shaft P, a differential mechanism D and wheels W and other various parts of the driving mechanism in such a manner that the wax supply to the nozzle device 54 is interrupted when the nozzle device 54 is directed toward the certain parts by controlling the solenoid valve 68. Thus, the wax from the second robot 21 can be effectively coated on the second area 22*b*.

When the receptor 15 detects a rear end of the vehicle 2, the first robots 3, 4 are controlled so as to stop working. Then, when the receptor 17 detects a rear end of the vehicle 2, the control device 18 controls the second robot 21 so that it stops working.

While the invention has been specifically described in connection with preferred embodiments thereof, it will be understood by those skilled in the art that the foregoing and other changes or modifications in form and details can be made therein without departing from the spirit and scope of the invention.

We claim:

1. A coating device for application of corrosion protection wax on a lower surface of a floor panel of a vehicle transferred by a slat conveyor, comprising:

first robot means for coating a first area with corrosion protection wax, formed within the lower surface of the floor panel at opposite peripheral portions of the floor panel to extend in a transfer direction in which the vehicle is transferred, second robot means for coating a second area with corrosion protection wax, formed within the lower surface of the floor panel between the opposite peripheral portions, control means for controlling movement of said first and second robot means, nozzle means provided on said first and second robot means for injecting the corrosion protection wax upwardly, the first and second robot means being arranged so as to be spaced from each other in the transfer direction and mounted in a chamber formed below the vehicle being transferred, the nozzle means on the first robot means extending transversely and projecting above the conveyor, first robot drive means included in said control means for reciprocating the first robot means transversely within the first area as the vehicle is transferred, and second robot drive means included in said control means for controlling movement of the second robot means with regard to five different axes so that the second robot means reciprocates longitudinally and transversely within the second area as the vehicle is transferred.

2. A coating device in accordance with claim 1 wherein the second robot means is arranged downstream of the first robot means with regard to the transfer direction.

3. A coating device in accordance with claim 1, wherein said nozzle means discharge different amounts of wax therefrom.

4. A coating device in accordance with claim 1, and further comprising means for moving the nozzle means provided in the first robot means around a vertical axis, a horizontal axis and in a substantially transverse direction perpendicular to the transfer direction.

5. A coating device in accordance with claim 1 further comprising position detecting means for detecting a position of the vehicle being transferred to produce a signal by which coating work by the robot means can be controlled.

6. A coating device in accordance with claim 5 wherein the position detecting means comprises a photoelectric tube.

7. A coating device in accordance with claim 1, and further comprising one or more actuator means, wherein the nozzle means provided on the second robot means is moved in substantially the transfer direction by the one or more actuator means.

8. A coating device in accordance with claim 7 wherein the second robot means is a multiple joint type which can make five different basic movements.

* * * * *